US005979089A

United States Patent [19]

Bouleau et al.

[11] Patent Number: 5,979,089

[45] Date of Patent: Nov. 9, 1999

[54] STEAM IRON WITH INDEPENDENT STEAM CHAMBERS

[75] Inventors: Jean-Paul Ange Andre Bouleau, Champfleur; Guy De Maneville, Alencon, both of France

[73] Assignee: Moulinex S.A., Paris, France

[21] Appl. No.: 09/066,466

[22] PCT Filed: Oct. 29, 1996

[86] PCT No.: PCT/FR96/01691

§ 371 Date: Apr. 30, 1998

§ 102(e) Date: Apr. 30, 1998

[87] PCT Pub. No.: WO97/17487

PCT Pub. Date: May 15, 1997

[30] Foreign Application Priority Data

Nov. 3, 1995 [FR] France ..... 95 12980

[51] Int. Cl.[6] ..... D06F 75/18

[52] U.S. Cl. ..... 38/77.83; 38/93

[58] Field of Search ..... 38/93, 77.83, 81, 38/97; 219/245, 255

[56] References Cited

U.S. PATENT DOCUMENTS

| | | | |
|---|---|---|---|
| 2,700,236 | 1/1955 | Marvin et al. . | |
| 3,919,793 | 11/1975 | Toft et al. . | |
| 4,017,988 | 4/1977 | Coggiola | 38/77.83 |
| 5,390,432 | 2/1995 | Boulud et al. | 38/77.38 |
| 5,613,309 | 3/1997 | Amsel et al. | 38/77.83 |
| 5,628,131 | 5/1997 | Chasen | 38/77.83 |
| 5,718,071 | 2/1998 | Zbriger | 38/77.83 |

FOREIGN PATENT DOCUMENTS

| | | | |
|---|---|---|---|
| 2254669 | 7/1975 | France . | |
| 2225345 | 5/1990 | United Kingdom | 38/93 |

*Primary Examiner*—Ismael Izaguirre
*Attorney, Agent, or Firm*—Young & Thompson

[57] ABSTRACT

This iron comprises a sole (10) having a heating base (15) and a plate (21) mounted below the base, and two steam chambers (28, 29) of which one (28) communicates with a first series of steam outlets (38) in the plate via corresponding steam distribution orifices (35), and of which the other (29) communicates with a second series of steam outlets (53) pierced in the plate via a steam distribution chamber (51) provided in the lower surface (23) of the base and communicating with said steam chamber (29). The distribution chamber (51) is located in the region located in the tip (11) of the heating base (15), and the second series of outlet holes (53) is grouped in the point (11) of the plate (21) of the sole.

8 Claims, 2 Drawing Sheets

FIG_1
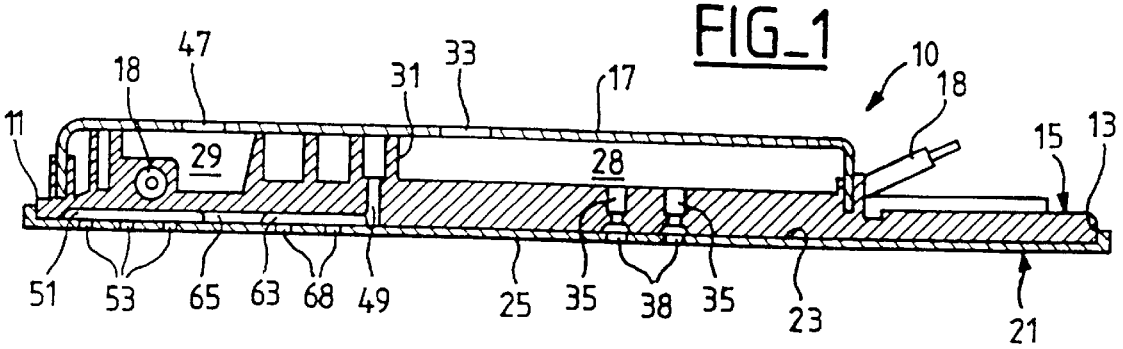
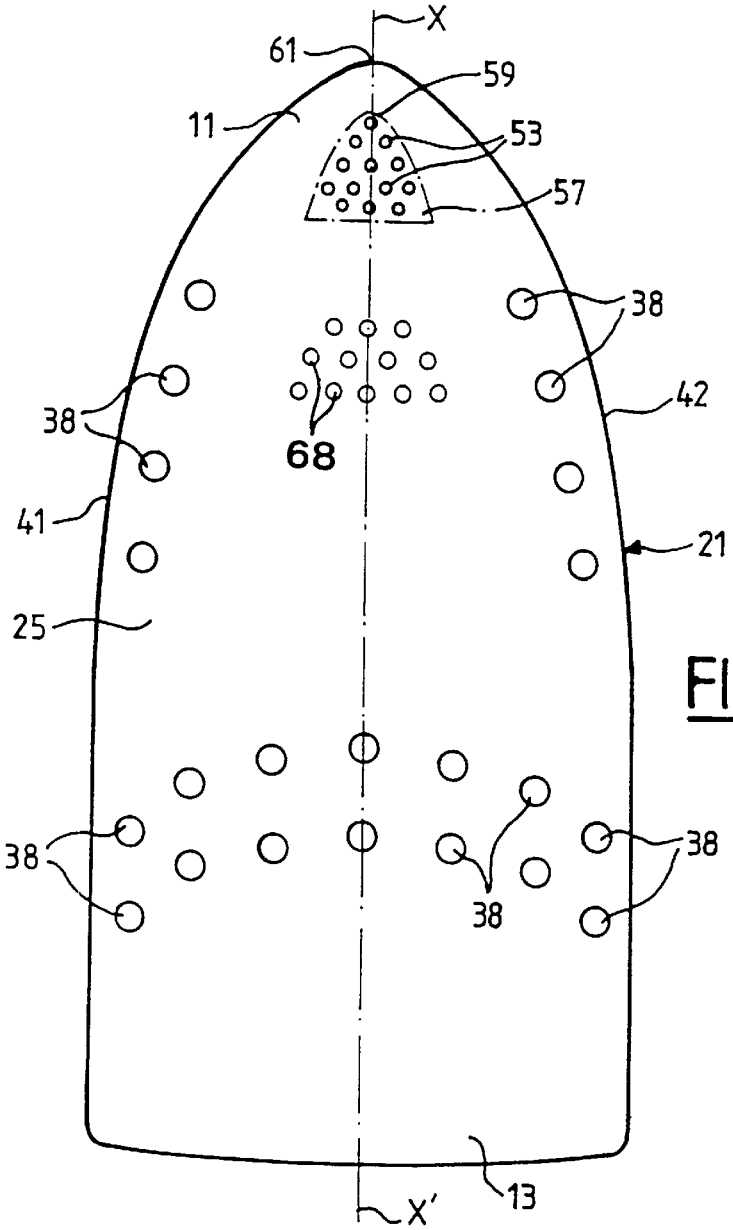
FIG_4

STEAM IRON WITH INDEPENDENT STEAM CHAMBERS

FIELD OF THE INVENTION

The present invention relates to irons which comprise a sole extending longitudinally from a tip toward a heel and comprising a heating base and an ironing plate mounted below said base.

It relates more particularly to irons which comprise two independent steam chambers provided in the base enclosed by a cover, namely a first principal steam chamber supplied with water by means of a first injection device through a first opening provided in the cover and communicating, by means of steam distribution openings through the lower surface of the base, with first steam outlets in the plate and communicating with said steam distribution openings, and a second steam chamber disposed before said first chamber, supplied with water by means of a second injection device through a second opening provided in the cover and communicating, by means of at least one through passage opening on the lower surface of the plate, with a steam distribution chamber provided in the lower surface of said base and communicating with second steam outlets in the plate.

BACKGROUND OF THE INVENTION

It is known that such irons with two independent steam chambers, of which the first so-called principal chamber is a chamber for the production of continuous jets of steam at low pressure and of which the second is a chamber for the production of steam jets at higher pressure and with penetrating force, are particularly effective to respond to the various characteristics of the cloth to be pressed.

In known steam irons of this type, the steam distribution chamber provided in the lower surface of the heating base, and correspondingly the corresponding steam outlet holes at high pressure and high penetration, are generally disposed roughly in the midportion of the sole. Such an arrangement of these steam outlets is completely satisfactory as to pressing quality, but nevertheless, it is relatively poorly adapted for the comfort of the user while pressing when the latter must carefully carry out the marking of the creases in thick cloth, for example shirt folds.

The invention particularly has for its object to overcome this drawback and to provide in a simple way a steam iron, of the type described above, whose sole gives the user better pressing conditions whilst ensuring high quality of pressing no matter what the characteristics of the cloth to be pressed.

SUMMARY OF THE INVENTION

According to the invention, a steam distribution chamber extends in a region located in the tip of the heating base of the sole, and the second steam outlets communicating with said steam distribution chamber are arranged in the tip of the sole plate.

Thus, thanks to this particular arrangement of the steam outlets at high pressure and strong penetration, the diffusion of the steam is concentrated at the very point of the sole, and hence the comfort of the user while pressing, particularly to mark the creases in cloth, is particularly improved because it suffices for the user to "follow" the tip of the sole, which can be considered the dynamic guide point, thereby correctly to direct the iron along the fold to be marked, permitting the user thus to carry out carefully and with considerable ease this operation of marking the folds of the cloth.

In a particular embodiment, the second steam outlets define together a steaming area of approximately triangular shape whose summit is located immediately adjacent the summit of the tip of the sole plate.

BRIEF DESCRIPTION OF THE DRAWINGS

The characteristics and advantages of the invention will become further apparent from the description which follows, by way of non-limiting example, with reference to the accompanying drawings, in which:

FIG. 1 is a transverse cross-sectional view of a sole closed by a cover of a steam iron according to the invention;

FIG. 4 is a plan view of the external surface of a pressing plate of the sole of FIG. 1.

DETAILED DESCRIPTION OF THE INVENTION

Figure 2:
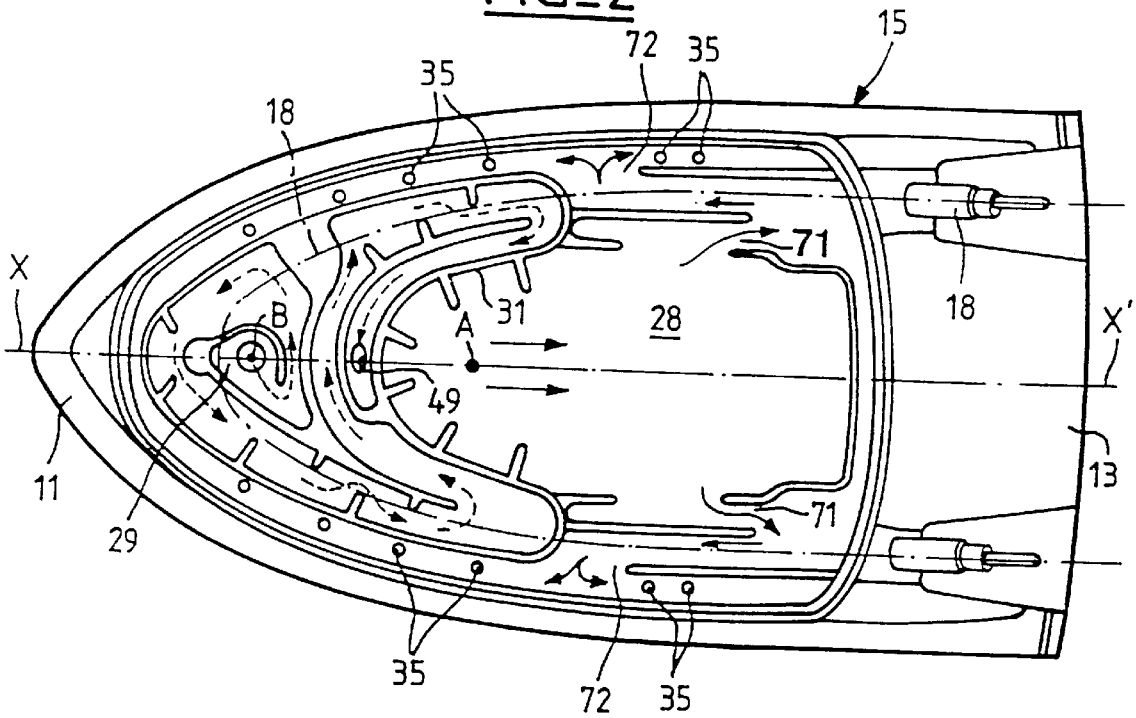
FIG. 2 is a plan view of a heating base of the sole of FIG. 1, the cover being omitted.

In the embodiment shown in FIGS. 1 to 4, an electric steam iron comprises a sole, designated by general reference numeral 10 in FIG. 1, which extends longitudinally from a region forming a point 11 toward a region forming a heel 13 and which comprises a base or body 15 in a cast metallic material, such as for example aluminum, closed sealingly by a cover 17 of sheet metal and heated by means of a shielded electric resistance 18 embedded in the mass and having a U shape, as well as a thin ironing plate 21 of metallic material such as for example chrome steel or stainless steel, mounted on the lower surface 23 of the heating base 15 by any suitable securement means and whose external surface 25 forms a pressing surface. The heating base 15 (FIGS. 2 and 3) and the pressing plate 21 (FIG. 4) of the sole have the same longitudinal axis of symmetry, designated XX'.

As shown in FIGS. 1 and 2, in the heating base 15 of the sole 10 are provided two independent steam chambers 28, 29 separated by a vertical partition 31 enclosed by the cover 17.

The first steam chamber 28, which is the principal chamber, is of large volume, and is adapted to produce a continuous current of steam at low pressure by being supplied with water by means of a first injection device (not shown) through a first opening 33 provided in the cover 17. This steam chamber 28 communicates, by means of steam distribution discharge ports 35 provided on the lower surface 23 of the base 15 (see FIGS. 2 and 3), with steam outlets 38 provided in the plate 21 (see FIG. 4) and communicating with the steam distribution discharge ports 35.

In this example, the steam outlets 38 are distributed, on the one hand, adjacent the two lateral edges 41, 42 of the plate 21, in the forward region of this latter, and on the other hand, in a region located approximately in the medial region of the plate 21 thanks to channels 44, 45 provided in the lower surface 23 of the base 15 (see FIG. 3) and adapted to distribute the steam from the steam distribution discharge ports 35 in this medial region of the plate 21 via the corresponding holes 38 of said plate 21.

The second steam chamber 29, of a volume substantially smaller than that of the first chamber 28, is disposed substantially above the shielded resistance 18 and in front of the first chamber 28, and is adapted to produce a current of steam at high pressure and having strong penetration, by being supplied with water by means of a second injection device (not shown) through a second opening 47 provided in the cover 17. This steam chamber 29 communicates, by means of at least one steam passage 49 opening on the lower surface 23 of the base 15 (see FIGS. 2 and 3), with a steam distribution chamber 51 provided in said lower surface 23 of the base 15 (see FIG. 3) and communicating with the outlet openings 53 provided in the plate 21 (FIG. 4).

According to the invention, the distribution chamber 51 (FIG. 3) extends in a region located at the tip 11 of the heating base 15 of the sole 10, and the steam outlets 53 (FIG. 4) communicating with the distribution chamber 51 are arranged in the tip 11 of the pressing plate 21 of the sole.

Figure 3:
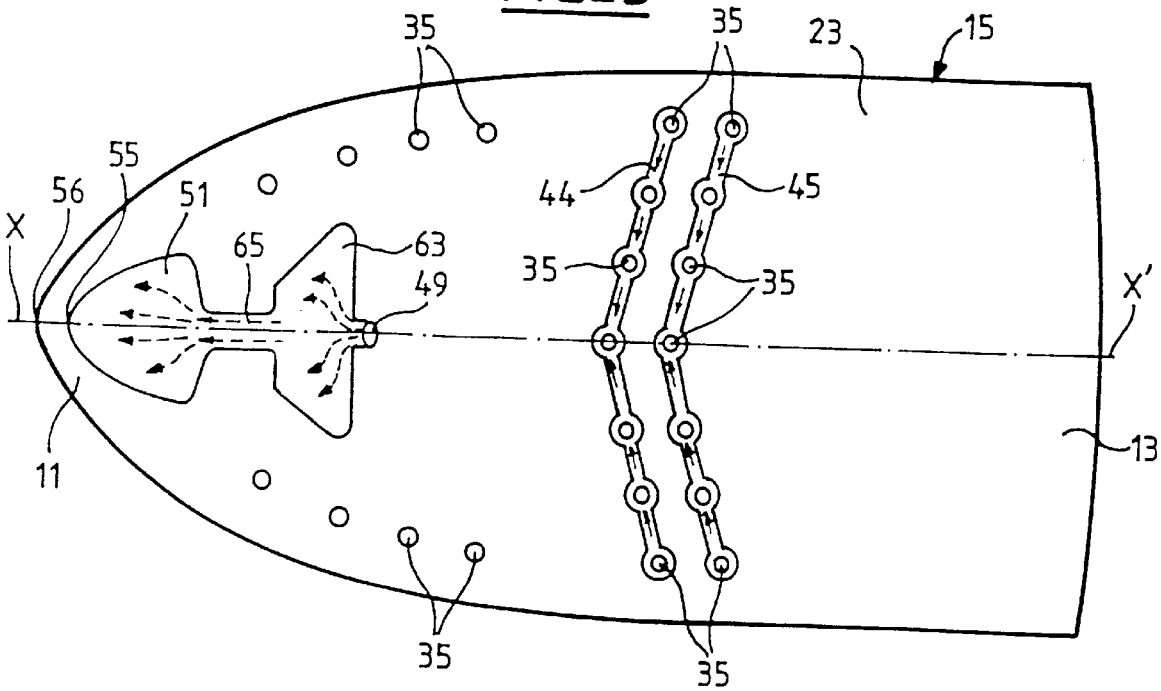
FIG. 3 is a bottom plan view of this heating base.

Preferably, as to FIGS. 3 and 4, the distribution chamber 51 is a chamber of small volume which has a profile that is symmetrical relative to the axis XX' of the base 15, in this case of approximately triangular shape whose summit 55 is located immediately adjacent, by about 1 to 3 centimeters, from the summit 56 of the tip 11 of the base 15, whilst the corresponding holes 53 define together a vaporization area 57 (delimited by the broken lines in FIG. 4) extending in front of the pressing plate 21 and having an approximately triangular shape whose summit 59 is located immediately adjacent, also by a distance of the order of 1 to 3 centimeters, from the summit 61 of the point 11 of the plate 21.

It will be understood that by this arrangement of the steam outlets 53 in the tip 11 of the sole 10, the diffusion of steam is concentrated entirely at the front of the steam iron, such that the tip 11 of the sole 10 serves advantageously as a guide for the user during pressing, in particular for the delicate execution of marking the folds of cloth or protecting the buttons on shirts.

In a preferred embodiment illustrated in FIG. 3, the lower surface 23 of the heating base 15 is rendered hollow by a chamber 63 for compression of the steam leaving the passage 49, whose outlet is located in the central rear portion of said compression chamber 63; this compression chamber 63, of small volume, is connected to the distribution chamber 51 by a small straight longitudinal channel 65 hollowed out of the lower surface 23 of the base 15 and adapted, by a sort of Venturi effect, to bring the steam to high speed from the compression chamber 63 to the distribution chamber 51. The compression chamber 63 is moreover communicating with the corresponding steam outlet openings 68 provided in the plate 21 (FIG. 4), these holes 68 being arranged so as to form an area of vaporization extending in the forward region of the plate 21 and adapted to increase the quality of ironing.

In this example, FIG. 3, the compression chamber 63 has an approximately trapezoidal shape whose bases are substantially orthogonal to the axis XX' of the heating base 15. The assembly formed by the trapezoidal compression chamber 63, the straight channel 65 and the triangular distribution channel 51 is coaxial with the axis XX' of the base 15, as is shown in FIG. 3.

Thus, during an injection of water into the principal vaporization chamber 28 through the opening 33 in the cover of the sole 10, the injected water (at point A located on the XX' axis of FIG. 2) is vaporized thanks to the heat of the shielded resistance 18. The vapor flows into the chamber 28, passes through passages designated 71 and 72 in FIG. 2, escapes through the openings 35 for steam distribution by distributing itself in part in the channels 44, 45, as shown in the full line arrows in FIGS. 2 and 3, and leaves in continuous jets at low pressure through the corresponding holes 38 of the ironing plate 21.

Moreover, during an injection of water into the vaporization chamber 29 through the opening 47 of the cover of the sole 10, the injected water (at point B located on the axis XX' of FIG. 2) is changed to vapor in contact with the metal heated by the shielded resistance 18. The steam then flows into the chamber 29 along a sinuous path in the direction of the arrows shown in broken line in FIG. 2, leaves by the passage 49 to open into the compression chamber 63 (FIG. 3) in which a portion of the vapor escapes through the outlet openings of the plate 21, then flows into the straight channel 65 to leave at high speed into the distribution chamber 51, as shown by the broken lines in FIG. 3, and escapes in jets at high pressure and high penetration through the outlet openings 53 provided in the point 11 of the iron plate 21.

We claim:

1. Steam iron comprising:

a sole extending longitudinally from a tip to a heel, said sole including a heating base, an ironing plate mounted below said base, and two independent chambers provided in said base and closed by a cover;

said chambers comprising a first principal steam chamber supplied with water through a first opening in the cover, and a second steam chamber disposed between said first chamber and said tip, and supplied with water through a second opening in the cover;

said first chamber communicating via steam distribution discharge ports provided in a lower surface of the base with first steam outlets provided in the plate;

said second chamber communicating via at least one through passage opening on the lower surface of the base with a distribution chamber provided in the lower surface of the base, said distribution chamber communicating with second steam outlets in the plate, and occupying a region located in the tip of the heating base of the sole; and said second steam outlets facing said distribution chamber and being grouped in the tip of the plate of the sole.

2. The steam iron according to claim 1, wherein the second steam outlets together define a vaporization region of approximately triangular shape whose summit is located immediately adjacent the summit of the tip of the sole plate.

3. The steam iron according to claim 2, wherein the steam distribution chamber also has an approximately triangular shape whose summit is located immediately adjacent the summit of the tip of the base of the sole.

4. The steam iron according to claim 1, wherein the heating base and the sole plate have a same longitudinal axis of symmetry, and the steam distribution chamber has a profile that is symmetrical relative to said axis of symmetry.

5. The steam iron according to claim 1, therein on the lower surface of the heating base of the sole, a central portion behind the steam distribution chamber is prolonged, via a small straight longitudinal channel for carrying away steam toward said steam distribution chamber, by a compression chamber for vapor leaving the through passage, said compression chamber having an outlet in a central rear portion, and said steam compression chamber being in communication with corresponding steam outlet holes pierced in the plate of the sole.

6. The steam iron according to claim 5, wherein the steam compression chamber has an approximately trapezoidal shape whose bases are substantially orthogonal to the axis of symmetry of the heating base of the sole, and said straight longitudinal channel and said trapezoidal compression chamber being coaxial with the base of the sole.

7. The steam iron according to claim 4, wherein on the lower surface of the heating base of the sole, a central portion behind the steam distribution chamber is prolonged, via a small straight longitudinal channel for carrying away steam toward said steam distribution chamber, by a compression chamber for vapor leaving the through passage, said compression chamber having an outlet in a central rear portion, and said steam compression chamber being in communication with corresponding steam outlet holes pierced in the plate of the sole.

8. The steam iron according to claim 7, wherein the steam compression chamber has an approximately trapezoidal shape whose bases are substantially orthogonal to the axis of symmetry of the heating base of the sole, and said straight longitudinal channel and said trapezoidal compression chamber being coaxial with the base of the sole.

* * * * *